US010294544B2

(12) United States Patent
Suehiro et al.

(10) Patent No.: US 10,294,544 B2
(45) Date of Patent: May 21, 2019

(54) METHOD FOR PRODUCING GRAIN-ORIENTED ELECTRICAL STEEL SHEET

(71) Applicant: JFE STEEL CORPORATION, Tokyo (JP)

(72) Inventors: Ryuichi Suehiro, Kurashiki (JP); Takashi Terashima, Kurashiki (JP); Makoto Watanabe, Okayama (JP); Toshito Takamiya, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 262 days.

(21) Appl. No.: 15/311,026

(22) PCT Filed: May 11, 2015

(86) PCT No.: PCT/JP2015/063445
§ 371 (c)(1),
(2) Date: Nov. 14, 2016

(87) PCT Pub. No.: WO2015/174362
PCT Pub. Date: Nov. 19, 2015

(65) Prior Publication Data

US 2017/0081740 A1 Mar. 23, 2017

(30) Foreign Application Priority Data

May 12, 2014 (JP) ..... 2014-098308

(51) Int. Cl.
*C22C 38/02* (2006.01)
*C22C 38/04* (2006.01)
(Continued)

(52) U.S. Cl.
CPC ..... *C21D 9/46* (2013.01); *C21D 3/04* (2013.01); *C21D 8/12* (2013.01); *C21D 8/1222* (2013.01);
(Continued)

(58) Field of Classification Search
None
See application file for complete search history.

(56) References Cited

U.S. PATENT DOCUMENTS 5,725,681 A 3/1998 Ishitobi et al.
2009/0032142 A1 2/2009 Kumano et al.
(Continued)

FOREIGN PATENT DOCUMENTS

CN 101395284 A 3/2009
CN 101454465 A 6/2009
(Continued)

OTHER PUBLICATIONS

Aug. 11, 2015 International Search Report issued in International Patent Application No. PCT/JP2015/063445.
(Continued)

*Primary Examiner* — Deborah Yee
(74) *Attorney, Agent, or Firm* — Oliff PLC

(57) ABSTRACT

In a method for producing a grain-oriented electrical steel sheet by subjecting a slab containing C: 0.002-0.10 mass %, Si: 2.5-6.0 mass %, Mn: 0.01-0.8 mass % and further containing Al and N, or S and/or Se, or Al, N, S and/or Se as inhibitor ingredients to hot rolling, hot band annealing, cold rolling, decarburization annealing, application of an annealing separator and finish annealing, when a certain temperature within a range of 700-800° C. in a heating process of the decarburization annealing is T1 and a certain temperature as a soaking temperature within a range of 820-900° C. is T2, a heating rate R1 between 500° C. and T1
(Continued)

is set to not less than 80° C./s and a heating rate R2 between T1 and T2 is set to not more than 15° C./s, whereby a grain-oriented electrical steel sheet having excellent magnetic properties and peeling resistance of forsterite coating is obtained while ensuring decarburization property.

9 Claims, 2 Drawing Sheets

(51) Int. Cl.

| | |
|---|---|
| ***C22C 38/06*** | (2006.01) |
| ***C22C 38/60*** | (2006.01) |
| ***C21D 8/12*** | (2006.01) |
| ***C21D 9/46*** | (2006.01) |
| ***C21D 3/04*** | (2006.01) |
| ***H01F 41/02*** | (2006.01) |
| ***H01F 1/047*** | (2006.01) |
| ***H01F 1/147*** | (2006.01) |
| ***H01F 1/16*** | (2006.01) |
| ***C22C 38/00*** | (2006.01) |
| ***C22C 38/08*** | (2006.01) |
| ***C22C 38/12*** | (2006.01) |
| ***C22C 38/16*** | (2006.01) |
| ***C22C 38/26*** | (2006.01) |
| ***C22C 38/34*** | (2006.01) |
| *H01F 3/02* | (2006.01) |

(52) U.S. Cl.

CPC ..... *C21D 8/1233* (2013.01); *C21D 8/1261* (2013.01); *C21D 8/1266* (2013.01); *C21D 8/1272* (2013.01); *C21D 8/1283* (2013.01); *C22C 38/00* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/26* (2013.01); *C22C 38/34* (2013.01); *C22C 38/60* (2013.01); *H01F 1/16* (2013.01); *H01F 3/02* (2013.01)

(56) References Cited

U.S. PATENT DOCUMENTS

| | | | |
|---|---|---|---|
| 2009/0165895 | A1 | 7/2009 | Ushigami et al. |
| 2011/0155285 | A1 | 6/2011 | Kumano et al. |
| 2014/0251514 | A1 | 9/2014 | Watanabe et al. |
| 2014/0338794 | A1 | 11/2014 | Shingaki et al. |
| 2015/0059929 | A1 | 3/2015 | Zaizen et al. |
| 2015/0243419 | A1 | 8/2015 | Senda et al. |

FOREIGN PATENT DOCUMENTS

| | | | |
|---|---|---|---|
| CN | 103781920 | A | 5/2014 |
| EP | 0987343 | A1 | 3/2000 |
| EP | 2933348 | A1 | 10/2015 |
| JP | H06-33142 | A | 2/1994 |
| JP | H06-172862 | A | 6/1994 |
| JP | H07-278670 | A | 10/1995 |
| JP | 2679928 | B2 | 11/1997 |
| JP | 2983128 | B2 | 11/1999 |
| JP | 2000-144249 | A | 5/2000 |
| JP | 2002-348613 | A | 12/2002 |
| JP | 3392669 | B2 | 3/2003 |
| JP | 2008-001977 | A | 1/2008 |
| JP | 2008-001978 | A | 1/2008 |
| JP | 2013-010982 | A | 1/2013 |
| JP | 2013-189712 | A | 9/2013 |
| KR | 10-0300209 | B1 | 4/1997 |
| KR | 10-2014-0044928 | A | 4/2014 |
| WO | 2010/029921 | A1 | 3/2010 |
| WO | 2013/039193 | A1 | 3/2013 |
| WO | 2013/058239 | A1 | 4/2013 |
| WO | 2013/137092 | A1 | 9/2013 |
| WO | 2014/049770 | A1 | 4/2014 |

OTHER PUBLICATIONS

Aug. 11, 2015 Written Opinion issued in International Application No. PCT/JP2015/063445.
Feb. 10, 2016 Office Action issued in Japanese Patent Application No. 2015-552311.
Sep. 25, 2017 Office Action issued in Chinese Patent Application No. 201580024474.2.
Feb. 15, 2018 Office Action issued in European Patent Application No. 15792135.4.
Dec. 15, 2017 Office Action issued in Korean Patent Application No. 2016-7030086.
Apr. 10, 2017 Search Report issued in European Patent Application No. 15792135.4.

METHOD FOR PRODUCING GRAIN-ORIENTED ELECTRICAL STEEL SHEET

TECHNICAL FIELD

This invention relates to a method for producing a grain-oriented electrical steel sheet suitable for use in an iron core material for a transformer or the like.

RELATED ART

Electrical steel sheets are soft magnetic materials widely used as an iron core material for transformers, motors and the like. Among them, grain-oriented electrical steel sheets exhibit excellent magnetic properties and are mainly used as an iron core material for large-size transformers and the like, because they are highly aligned into a crystal grain orientation of {110}<001> orientation called as Goss orientation. To this end, a main subject for development of the conventional grain-oriented electrical steel sheets lies in the reduction of loss, or iron loss caused in the excitation of the steel sheet for reducing no-load loss of the transformer (energy loss).

To this end, there have been made a large number of researches and developments for reducing iron loss of the grain-oriented electrical steel sheet. Among them, a method of refining secondary recrystallized grains is mentioned as one of the methods effective for reducing iron loss. This method is aimed to reduce Joule heat generated by eddy current associated with magnetic domain wall movement when the steel sheet is excited, or abnormal eddy current loss.

As a method of industrially attaining the refining of the secondary recrystallized grains is known a method wherein rapid heating up to not lower than 700° C. is performed at a heating rate of not less than 80° C./s just before decarburization annealing or in the heating process of decarburization annealing as disclosed, for example, in Patent Document 1. This is a technique that when the rapid heating is applied to the steel sheet after the final cold rolling, Goss orientation ({110}<001>) as a nucleus for secondary recrystallization in a primary recrystallized texture after decarburization annealing is increased and then many nuclei of Goss orientation are subjected to secondary recrystallization in the subsequent finish annealing to relatively refine the secondary recrystallized grains.

In the decarburization annealing, an annealing atmosphere is rendered oxidizing, so that an oxide coating composed mainly of Si and Fe oxides (this oxide coating is called as "subscale" hereinafter) is formed on the surface of the steel sheet. When an annealing separator composed mainly of MgO is applied onto the surface of the steel sheet having the subscale to perform finish annealing, a forsterite ($Mg_2SiO_4$) coating layer is formed by the reaction of the subscale and MgO, which plays a role as an insulation coating when product sheets are stacked in use. In the method of heating the steel sheet to a higher temperature for a short time as disclosed in Patent Document 3, however, fayalite ($Fe_2SiO_4$) is excessively formed in the oxide coating formed on the surface of the steel sheet, so that there is a problem that the formation of the forsterite ($Mg_2SiO_4$) coating layer becomes unstable in the subsequent finish annealing.

As a countermeasure to this problem, for example, Patent Document 2 discloses a technique that rapid heating is performed in a non-oxidizing atmosphere having an oxygen potential $P_{H2O}/P_{H2}$ of not more than 0.2 to suppress the excessive formation of fayalite in an initial oxidation. However, there is a problem that a dense oxide layer is formed on the surface of the steel sheet by the rapid heating in the non-oxidizing atmosphere to block decarburization reaction in the subsequent decarburization annealing. If C is not removed in the decarburization annealing sufficiently and is retained in the product sheet, the magnetic properties of the product sheet are deteriorated with the lapse of time, or so-called magnetic aging is caused. Therefore, Patent Document 3 proposes a technique that a wet hydrogen atmosphere having an oxygen potential $P_{H2O}/P_{H2}$ of not less than 0.41 is used to suppress the formation of the dense oxide layer and ensure the decarburization property.

PRIOR ART DOCUMENTS

Patent Documents

Patent Document 1: Japanese Patent No. 2679928
Patent Document 2: Japanese Patent No. 2983128
Patent Document 3: Japanese Patent No. 3392669

SUMMARY OF THE INVENTION

Task to be Solved by the Invention

However, the technique of Patent Document 3 performing the rapid heating in an oxidizing atmosphere is opposite to the technique of Patent Document 2 forming the forsterite coating by heating in a non-oxidizing atmosphere. Therefore, the conventional techniques have a problem that it is difficult to establish the decarburization property and the stable formation of the forsterite coating over a full length of a coil.

As previously mentioned, the poor decarburization causes the deterioration of the magnetic properties due to magnetic aging. And also, the forsterite coating improves the iron loss when tension is applied to the steel sheet, while when the grain-oriented electrical steel sheets are stacked in use as an iron core or the like, the coating functions as an insulation layer of suppressing flowing of an eddy current through the stacked steel sheets to prevent the increase of the iron loss. However, if the formation of the forsterite coating is insufficient, the coating is peeled off from the surface of the steel sheet when deformation such as bending or the like is applied to the steel sheet, which causes the deterioration of the insulation property.

The invention is made in view of the above problems inherent to the conventional techniques and is to propose a method for producing a grain-oriented electrical steel sheet wherein even if rapid heating is performed in the heating process of decarburization annealing, the decarburization property is ensured sufficiently and the formation of the forsterite coating in the finish annealing is stabilized to provide excellent iron loss property and peeling resistance of forsterite coating over a full length of a coil.

Solution for Task

The inventors have focused on a heating pattern in the heating process of the decarburization annealing and made various studies for solving the above problems. As a result, it has been found that when a heating rate at a high temperature exceeding 700° C. is controlled to an adequate range in the heating process of the decarburization annealing, the formation of excessive fayalite can be suppressed on the surface layer of the steel sheet to form a sound oxide layer and the decarburization property can be ensured sufficiently, and hence the invention has been accomplished.

The invention proposes a method for producing a grain-oriented electrical steel sheet by comprising a series of steps of subjecting a slab having a chemical composition comprising C: 0.002-0.10 mass %, Si: 2.5-6.0 mass %, Mn:

0.01-0.8 mass % and further containing Al: 0.010-0.050 mass % and N: 0.003-0.020 mass %, or S: 0.005-0.03 mass % and/or Se: 0.002-0.03 mass %, or Al: 0.010-0.050 mass %, N: 0.003-0.020 mass %, S: 0.005-0.03 mass % and/or Se: 0.002-0.03 mass %, and the remainder being Fe and inevitable impurities to hot rolling, hot band annealing, one or two or more cold rollings sandwiching an intermediate annealing therebetween, formation of subscale on steel sheet surface through decarburization annealing, application of an annealing separator composed mainly of MgO onto steel sheet surface and finish annealing, characterized in that when a certain temperature within a range of 700-800° C. in a heating process of the decarburization annealing is T1 and a certain temperature as a soaking temperature within a range of 820-900° C. is T2, a heating rate R1 between 500° C. and T1 is set to not less than 80° C./s and a heating rate R2 between T1 and T2 is set to not more than 15° C./s.

The production method of the grain-oriented electrical steel sheet according to the invention is characterized in that an oxygen potential $P_{H2O}/P_{H2}$ in an atmosphere reaching to the soaking temperature T2 in the decarburization annealing is within a range of 0.30-0.55.

Also, the production method of the grain-oriented electrical steel sheet according to the invention is characterized in that while a temperature is cooled to not higher than 800° C. after the soaking temperature T2 is reached in the decarburization annealing, a time of keeping a temperature of not lower than the soaking temperature T2 but not higher than 900° C. and making an oxygen potential $P_{H2O}/P_{H2}$ of the atmosphere not more than 0.10 is set to be not less than 5 seconds.

Furthermore, the production method of the grain-oriented electrical steel sheet according to the invention is characterized in that a coating weight converted to oxygen per one-side surface of the steel sheet after the decarburization annealing is 0.35-0.85 g/m$^2$.

The slab used in the production method of the grain-oriented electrical steel sheet according to the invention is characterized by containing one or more selected from Cr: 0.01-0.50 mass %, Cu: 0.01-0.50 mass %, P: 0.005-0.50 mass %, Ni: 0.01-1.50 mass %, Sb: 0.005-0.50 mass %, Sn: 0.005-0.50 mass %, Mo: 0.005-0.100 mass %, B: 0.0002-0.0025 mass %, Nb: 0.0010-0.0100 mass % and V: 0.001-0.01 mass % in addition to the above chemical composition.

Further, the production method of the grain-oriented electrical steel sheet according to the invention is characterized in that the surface of the steel sheet is subjected to magnetic domain refining treatment at either step after the cold rolling.

Effect of the Invention

According to the invention, it is possible to stably provide a grain-oriented electrical steel sheet having excellent iron loss property and forsterite coating peeling resistance over a full length of coil.

EMBODIMENTS FOR CARRYING OUT THE INVENTION

Figure 1:
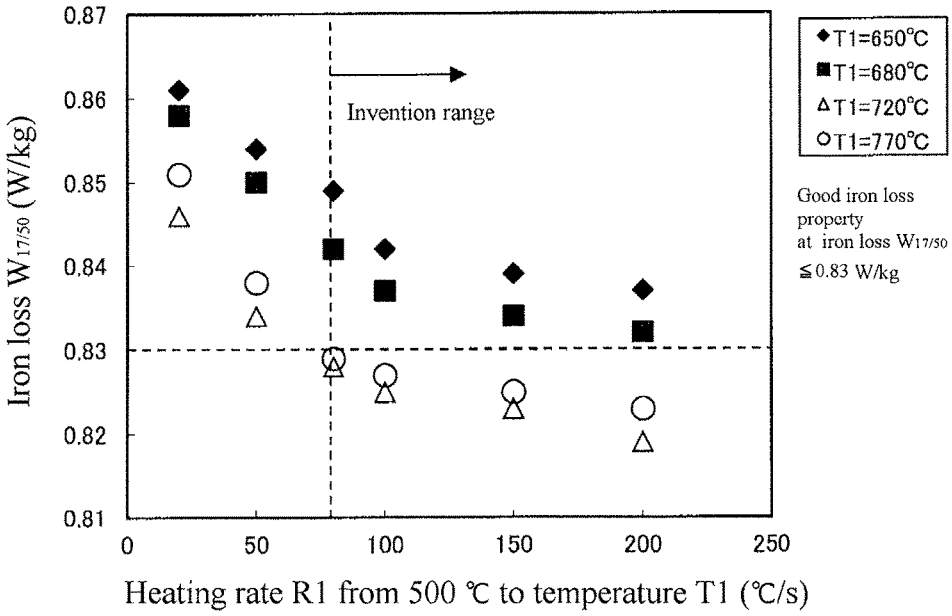
FIG. 1 is a graph showing an influence of a heating rate R1 from 500° C. to a temperature T1 upon iron loss $W_{17/50}$.

The reason why Goss orientation in a primary recrystallized texture of a steel sheet is increased by rapid heating in a heating process of decarburization annealing is due to the fact that when recrystallization is promoted at a low temperature, grains with {111} plane are preferentially recrystallized, while when recrystallization is promoted at a high temperature, recrystallization of Goss orientation or the like, which is easy in the recrystallization followed to the {111} plane orientation, is promoted. Therefore, in order to suppress the recrystallization at the low temperature, it is desirable to perform the heating up to the high temperature in a short time as much as possible, or perform rapid heating.

On the other hand, when the steel sheet is rapidly heated to a high temperature advancing decarburization reaction, decarburization at the low temperature is inhibited, while the formation of a dense oxide layer composed of silica and fayalite on the surface layer of the steel sheet is blocked, and hence the formation of forsterite coating in the finish annealing becomes unstable.

The inventors have made the following various experiments and found out that it is possible to simultaneously establish securement of decarburization property and formation of an oxide layer required for sound forsterite coating by rapidly heating up to a temperature sufficiently forming Goss orientation, decreasing a heating rate and thereafter heating up to a soaking temperature of decarburization annealing.

<Experiment 1>

The inventors have made the following experiment in order to examine conditions providing a good iron loss property by performing a heating process of decarburization annealing through rapid heating.

A steel raw material (slab) containing C: 0.07 mass %, Si: 3.0 mass %, Mn: 0.06 mass %, Al: 0.024 mass %, N: 0.0085 mass %, S: 0.02 mass % and Se: 0.025 mass % is reheated to 1400° C. and hot-rolled to form a hot rolled sheet of 2.2 mm in thickness, which is subjected to a hot band annealing at 1100° C. for 60 seconds and then cold-rolled to form a cold rolled sheet having a thickness of 1.5 mm. The cold rolled sheet is thereafter subjected to an intermediate annealing at 1120° C. for 80 seconds and cold-rolled to form a cold rolled sheet having a final thickness of 0.23 mm, from which are cut out many specimens having a width of 100 mm and a length of 300 mm in the rolling direction as a lengthwise direction.

Then, these specimens are heated from room temperature to various temperatures T1 within a range of 650-770° C. in a wet hydrogen atmosphere having an oxygen potential $P_{H2O}/P_{H2}$=0.40 by variously changing a heating rate R1, and thereafter heated from the temperature T1 to a soaking temperature T2 of 850° C. at a heating rate of 10° C./s, and then subjected to decarburization annealing by soaking at 850° C. in the same atmosphere for 120 seconds.

Next, the specimen after the decarburization annealing is coated with an annealing separator composed mainly of MgO and subjected to secondary recrystallization and further finish annealing for purification by keeping at 1150° C. for 6 hours.

With respect to the thus obtained specimens after the finish annealing is measured an iron loss $W_{17/50}$ at a magnetic flux density of 1.7 T and an excitation frequency of 50 Hz according to JIS C2550.

The results of the above experiment are shown in FIG. 1. As seen from FIG. 1, the iron loss $W_{17/50}$ tends to be reduced as the heating rate R1 becomes larger, but the heating rate R1 is not less than 80° C./s for providing a good iron loss of $W_{17/50} \leq 0.83$ W/kg. Also, it can be seen that when a temperature T1 for changing the heating rate to 10° C./s is lower than 700° C., the good iron loss cannot be obtained even if the heating rate R1 is made larger.

<Experiment 2>

The following experiment is made for examining a balance between decarburization property and forsterite coating peeling resistance when the heating rate is decreased on the way of the heating.

The specimens of 0.23 mm in thickness obtained in Experiment 1 are used and heated from 500° C. to various temperatures T1 (700° C.<T1<850° C.) in a wet hydrogen atmosphere having an oxygen potential $P_{H2O}/P_{H2}=0.40$ at a heating rate R1 of 200° C./s, and thereafter heated from the temperature T1 to a soaking temperature T2 of 850° C. at various heating rates R2, and then subjected to decarburization annealing by soaking at 850° C. in the same atmosphere for 120 seconds.

With respect to one of the specimens subjected to decarburization annealing under the same condition is identified a carbon concentration in the steel sheet after the decarburization annealing by means of an infrared absorption method after combustion. The remaining specimens after the decarburization annealing are coated on their steel sheet surfaces with an annealing separator composed mainly of MgO and subjected to secondary recrystallization and further finish annealing for purification by keeping at 1150° C. for 6 hours.

With respect to the thus obtained specimens after the finish annealing is measured an iron loss $W_{17/50}$ at a magnetic flux density of 1.7 T and an excitation frequency of 50 Hz according to JIS C2550, while a test is carried out for evaluating a peeling resistance of the forsterite coating. In the test of the peeling resistance, the specimens cut into a width of 30 mm are wound on a plurality of cylindrical rods having diameters different every 10 mm within a range of 10-100 mmϕ in the longitudinal direction to evaluate the peeling resistance by a minimum diameter causing no coating peeling (peeling diameter). In this case, the generation of the coating peeling is peeling off of the coating or generation of white lines on the surface of the specimen through breakage of the coating. Moreover, the decarburization property is evaluated as good when C concentration after the decarburization annealing is not more than 0.0025 mass % (25 mass ppm), while the peeling resistance is evaluated as good when the peeling diameter is not more than 30 mmϕ.

Figure 2:
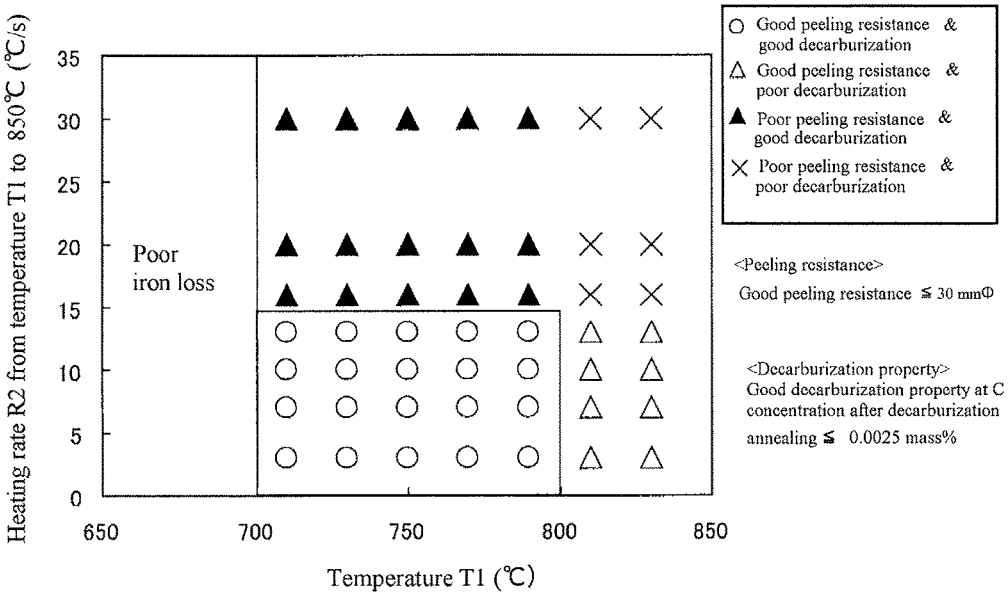
FIG. 2 is a graph showing an influence of a temperature T1 and a heating rate R2 from temperature T1 to 850° C. upon forsterite coating peeling resistance.

In FIG. 2 is shown an influence of temperature T1 and heating rate R2 upon decarburization property and peeling resistance of the coating. As seen from FIG. 2, poor decarburization is caused at a temperature T1 exceeding 800° C., while the peeling resistance is deteriorated at a heating rate R2 exceeding 15° C./s even when the temperature T1 is within a range of 700-800° C.

From the results of <Experiment 1> and <Experiment 2>, it can be seen that the decarburization property and peeling resistance of the coating can be ensured while maintaining the good iron loss property when the heating rate R1 in the rapid heating for decarburization annealing is not less than 80° C./s and the temperature T1 stopping the rapid heating is not lower than 700° C. but not higher than 800° C. and the heating rate R2 from the temperature T1 to the soaking temperature T2 is not more than 15° C./s.

Then, the inventors have made research and examination on an influence of an atmosphere during decarburization annealing upon the decarburization property and forsterite coating peeling resistance. As previously mentioned, the atmosphere in the heating for decarburization annealing largely exerts on the decarburization property and formation of forsterite coating. As shown in the above experimental results, the decarburization property and the formation of forsterite coating having an excellent peeling resistance can be established by decreasing the heating rate on the way of the rapid heating for decarburization annealing. However, it is considered that the good decarburization property and the formation of forsterite coating provided with an excellent peeling resistance can be attained by combining with a more preferable heating atmosphere.

<Experiment 3>

A slab containing C: 0.08 mass %, Si: 3.3 mass %, Mn: 0.07 mass %, Al: 0.026 mass %, N: 0.0085 mass %, S: 0.025 mass % and Se: 0.03 mass % is reheated to 1400° C., hot-rolled to form a hot rolled sheet of 2.2 mm in thickness, which is subjected to a hot band annealing at 1100° C. for 60 seconds and cold-rolled to form a cold rolled sheet having a thickness of 1.5 mm. Thereafter, the cold rolled sheet is subjected to an intermediate annealing at 1120° C. for 80 seconds and cold-rolled to form a cold rolled sheet having a final thickness of 0.23 mm, from which are cut out many specimens with a width of 100 mm and a length of 300 mm in the rolling direction as a longitudinal direction.

Then, the specimens are heated from 500° C. to a temperature T1 (=720° C.) at a heating rate R1 (=180° C./s) in a wet hydrogen atmosphere adjusted to various oxygen potentials $P_{H2O}/P_{H2}$ and thereafter heated from the temperature T1 to a soaking temperature T2 of 850° C. at a heating rate of 8° C./s and then subjected to decarburization annealing by soaking at 850° C. in a wet hydrogen atmosphere adjusted to $P_{H2O}/P_{H2}=0.41$ for 120 seconds.

With respect to one of the specimens subjected to decarburization annealing under the same condition is identified a carbon concentration in the steel sheet after the decarburization annealing by means of an infrared absorption method after combustion. The remaining specimens after the decarburization annealing are coated on their steel sheet surfaces with an annealing separator composed mainly of MgO and subjected to secondary recrystallization and further finish annealing by keeping at 1150° C. for 6 hours.

With respect to the specimens thus obtained after the finish annealing is evaluated a peeling resistance of the forsterite coating in the same manner as in Experiment 2.

Figure 3:
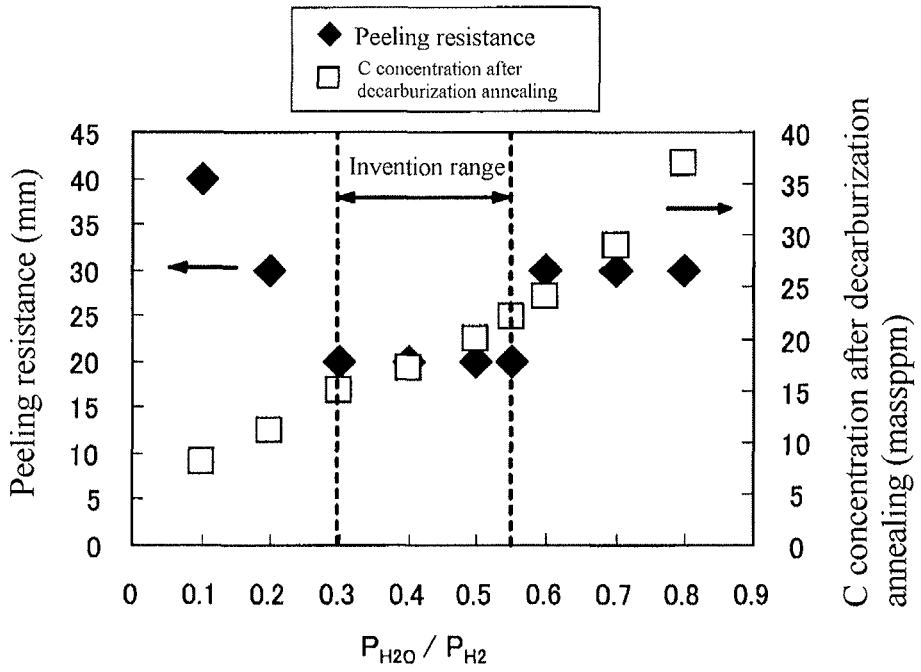
FIG. 3 is a graph showing an influence of an oxygen potential $P_{H2O}/P_{H2}$ of an atmosphere during the heating for decarburization annealing upon decarburization property and forsterite coating peeling resistance.

In FIG. 3 is shown an influence of an oxygen potential $P_{H2O}/P_{H2}$ of an atmosphere in the heating upon C concentration after decarburization annealing and peeling resistance of forsterite coating. As seen from FIG. 3, good decarburization property and peeling resistance can be obtained by controlling the oxygen potential $P_{H2O}/P_{H2}$ of the atmosphere at not higher than the temperature T2 to a range of not less than 0.30 but not more than 0.55.

Further, the inventors have examined a method of further reducing the iron loss in the method of the invention wherein the heating rate is decreased on the way of the rapid heating during the decarburization annealing.

When the oxidizability of the atmosphere is lowered in the heating process of the decarburization annealing, the formation of initial oxide layer formed in the heating process is delayed, so that the reaction between the iron matrix of the steel sheet and the oxidizing atmosphere is easily promoted at the stage of soaking at a high temperature during the decarburization annealing and the coating weight converted to oxygen after the decarburization annealing increases. On the other hand, when the oxidizability is made high in the heating process, a dense oxide layer is formed on the way of the heating, but decarburization is blocked by this dense oxide layer, so that the oxidation of the iron matrix is suppressed after the temperature reaches to the soaking temperature of the decarburization annealing and the coating weight converted to oxygen after the decarburization annealing decreases.

In the finish annealing, the remaining dense oxide layer has an effect that the penetration of nitrogen used as an inert gas in the annealing atmosphere into the iron matrix through the coating is suppressed to prevent precipitation of AlN due to the bonding to Al in steel. AlN is originally a precipitate used for causing secondary recrystallization only in the Goss orientation as an inhibitor. However, when AlN exists excessively in steel, secondary recrystallization is suppressed up to a high temperature in the finish annealing, so that preferential growth property in Goss orientation is lost in the secondary recrystallization, and hence crystal grains are grown in orientations other than the Goss orientation. From a viewpoint of obtaining secondary recrystallized grains having a high orientation integrating degree, therefore, it is desirable that a denes oxide layer is formed on the surface of the steel sheet after decarburization annealing.

If the rapid heating is not performed (heating rate of about 20° C./s), the formation of oxide layer in the surface layer of the steel sheet is caused prior to the decarburization, so that the formation of the dense oxide layer at the initial heating stage is not desirable in view of the subsequent decarburization. In the case of performing the rapid heating, the formation of the oxide layer is suppressed up to a relatively high temperature, so that it is considered to simultaneously cause the formation of initial oxide layer and the decarburization. Therefore, even if the dense oxide layer is formed in the surface layer of the steel sheet, the decarburization property can be ensured sufficiently and also the penetration of nitrogen into steel in the finish annealing can be suppressed, and hence the more reduction of iron loss can be expected. Now, the following experiment is made for validating the above hypothesis.

<Experiment 4>

A slab containing C: 0.07 mass %, Si: 3.4 mass %, Mn: 0.07 mass %, Al: 0.025 mass %, N: 0.0085 mass %, S: 0.025 mass % and Se: 0.03 mass % is reheated to 1400° C. and hot-rolled to form a hot rolled sheet of 2.2 mm in thickness, which is subjected to a hot band annealing at 1100° C. for 60 seconds and then cold-rolled to form a cold rolled sheet having a thickness of 1.5 mm. The cold-rolled sheet is thereafter subjected to an intermediate annealing at 1120° C. for 80 seconds and cold-rolled to form a cold-rolled sheet having a final thickness of 0.23 mm, from which are cut out many specimens having a width of 100 mm and a length of 300 mm in the rolling direction as a longitudinal direction.

The specimens are heated from 500° C. to a temperature T1 (=710° C.) at a heating rate R1 (=200° C./s) in wet hydrogen atmospheres adjusted to various oxygen potentials $P_{H2O}/P_{H2}$ and then heated from the temperature T1 to a soaking temperature T2 of 850° C. at a heating rate of 8° C./s, and thereafter subjected to decarburization annealing by soaking at 850° C. in a wet hydrogen atmosphere adjusted to $P_{H2O}/P_{H2}$=0.41 for 120 seconds.

Next, one specimen per each condition is taken out from the specimens after the decarburization annealing to identify carbon concentration after the decarburization annealing by the aforementioned method. Also, the same specimen is used to identify oxygen concentration in the steel sheet after the decarburization annealing by an infrared absorption method after fusion, from which is calculated a coating weight converted to oxygen per one-side surface supposing that all oxygen is equally distributed in surface layers at the both surfaces of the steel sheet.

On the other hand, the remaining specimens are coated on their steel sheet surfaces after the decarburization annealing with an annealing separator composed mainly of MgO and subjected to secondary recrystallization and further finish annealing for purification by keeping at 1150° C. for 6 hours.

With respect to the thus obtained specimens after the finish annealing, the iron loss $W_{17/50}$ is measured in the same manner as in Experiment 1, while the peeling resistance of forsterite coating is evaluated in the same manner as in Experiment 2. Moreover, the iron loss value is determined as an average value by measuring 10 specimens per each condition.

Figure 4:
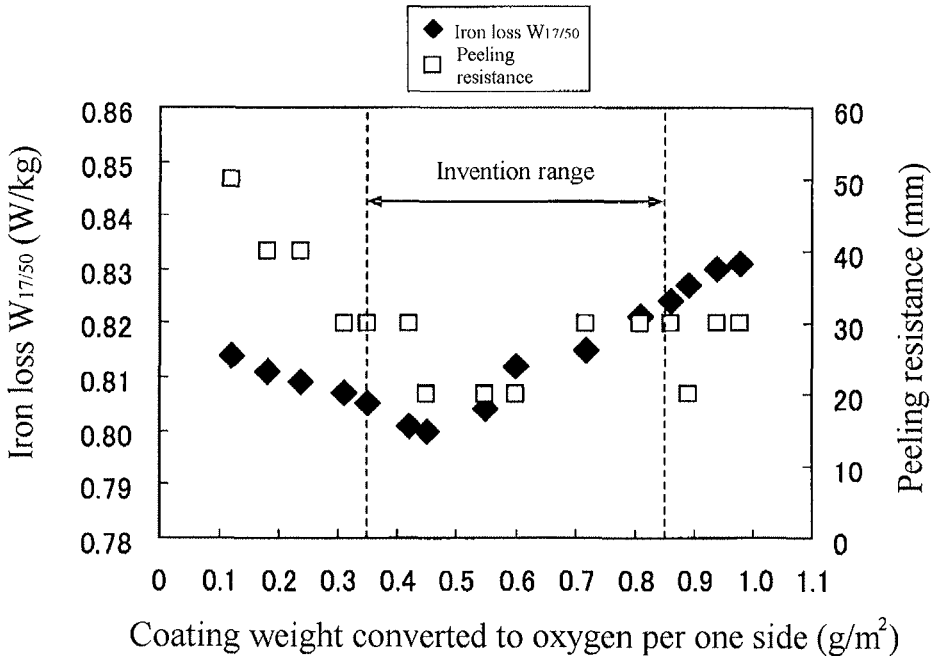
FIG. 4 is a graph showing an influence of a coating weight converted to oxygen after the decarburization annealing upon iron loss $W_{17/50}$ and forsterite coating peeling resistance.

In FIG. 4 is shown an influence of the coating weight converted to oxygen per one side surface of the steel sheet after the decarburization annealing upon the iron loss $W_{17/50}$ and the peeling resistance of forsterite coating. It can be seen that when the coating weight converted to oxygen per one side surface is made to not more than 0.85 g/m$^2$, the dense oxide layer is formed in the surface layer of the steel sheet and the better iron loss is obtained without changing a heat pattern in the heating process of the decarburization annealing. However, the peeling resistance is deteriorated even if the coating weight converted to oxygen falls below 0.35 g/m$^2$. This is considered due to the fact that when the coating weight converted to oxygen is less than 0.35 g/m$^2$, an absolute quantity of silica in a subscale formed in the decarburization annealing becomes too small and the amount of forsterite coating formed in the finish annealing is lacking.

The invention is based on the above knowledge.

A chemical composition of a raw steel material (slab) used in the production of the grain-oriented electrical steel sheet according to the invention will be described below.

C: 0.002-0.10 mass %

C is an element useful for producing crystal grains of Goss orientation. In order to develop such an action effectively, it is necessary to be contained in an amount of not less than 0.002 mass %. While when it exceeds 0.10 mass %, poor decarburization is caused in the decarburization annealing, which causes magnetic aging of a product sheet. Therefore, C is a range of 0.002-0.10 mass %. Preferably, it is a range of 0.01-0.08 mass %.

Si: 2.5-6.0 mass %

Si is an element required for increasing specific resistance of steel and reducing iron loss. When it is less than 2.5 mass %, the above effect is not sufficient, while when it exceeds 6.0 mass %, workability of steel is deteriorated and it is difficult to perform rolling. Therefore, Si is a range of 2.5-6.0 mass %. Preferably, it is a range of 2.9-5.0 mass %.

Mn: 0.01-0.8 mass %

Mn is an element required for improving hot workability. When it is less than 0.01 mass %, the above effect is not obtained sufficiently, while when it exceeds 0.8 mass %, the magnetic flux density after the secondary recrystallization lowers. Therefore, Mn is a range of 0.01-0.8 mass %. Preferably, it is a range of 0.05-0.5 mass %.

In addition to the above ingredient, the raw steel material used in the invention is necessary to contain Al: 0.010-0.050 mass % and N: 0.003-0.020 mass %, or S: 0.005-0.03 mass % and/or Se: 0.002-0.03 mass %, or Al: 0.010-0.050 mass %, N: 0.003-0.020 mass %, S: 0.005-0.03 mass % and/or Se: 0.002-0.03 mass % as inhibitor forming ingredients. When each content is less than the lower limit, the inhibitor effect cannot be sufficiently obtained, while when it exceeds the upper limit, the temperature of dissolution is increased, and hence the ingredients are left at an undissolved state in the reheating of the slab to deteriorate magnetic properties.

In addition to the above ingredient, the raw steel material used in the invention may contain one or more selected from Cr: 0.01-0.50 mass %, Cu: 0.01-0.50 mass % and P: 0.005-0.50 mass % for the purpose of reducing the iron loss, or may contain one or more selected from Ni: 0.010-1.50 mass %, Sb: 0.005-0.50 mass %, Sn: 0.005-0.50 mass %, Mo: 0.005-0.100 mass %, B: 0.0002-0.0025 mass %, Nb: 0.0010-0.010 mass % and V: 0.001-0.010 mass % for the purpose of increasing the magnetic flux density. When each amount of these elements added is less than the lower limit, the effect of improving the magnetic properties is small, while when it exceeds the upper limit, the growth of the secondary recrystallized grains is suppressed to deteriorate the magnetic properties.

The remainder other than the above ingredients is Fe and inevitable impurities, but ingredients other the above ingredients may be contained within a scope not damaging the effect of the invention.

There will be described the production method of the grain-oriented electrical steel sheet according to the invention below.

The raw steel material (slab) used in the invention is preferable to be produced by continuously casting through a continuous casting method or an ingot making-blooming method after a steel having the above chemical composition is melted by a well-known refining process.

The slab is reheated to a given temperature and hot-rolled by a usual method. In this case, the reheating temperature is approximately 1400° C. for dissolving the inhibitor ingredients.

The steel sheet after the hot rolling (hot rolled sheet) is subjected to hot band annealing in order to provide good magnetic properties. The annealing temperature is preferable to be a range of 800-1150° C. When it is lower than 800° C., it is difficult to obtain primary recrystallization texture of aligned grains because band structure formed in the hot rolling retains, which blocks the development of secondary recrystallization. While when it exceeds 1150° C., the grain size after the hot band annealing becomes too coarsened and hence it is difficult to provide the primary recrystallization texture of aligned grains.

The steel sheet after the hot band annealing is subjected to a single cold rolling or two or more cold rollings sandwiching an intermediate annealing therebetween to form a cold rolled sheet having a final thickness. In the case of performing the intermediate annealing, the annealing temperature is preferable to be a range of 900-1200° C. When it is lower than 900° C., the recrystallized grains are refined to decrease nuclei of Goss orientation in the primary recrystallization texture to thereby bring about the deterioration of magnetic properties. While when it exceeds 1200° C., the grain size becomes too coarsened like the hot band annealing and it is difficult to provide the primary recrystallization texture of aligned grains.

As the final cold rolling to the final thickness may be adopted warm rolling performed by raising a temperature of the steel sheet during the rolling to 100-300° C. or one or more aging treatments within a range of 100-300° C. may be performed on the way of the cold rolling, which is effective to improve the primary recrystallization texture and improve the magnetic properties of a product sheet.

Thereafter, the cold rolled sheet of the final thickness is subjected to decarburization annealing being the most important in the invention.

A soaking temperature T2 in the decarburization annealing is preferable to be a range of 820-900° C. from a viewpoint of ensuring the decarburization property.

In the heating process of the decarburization annealing, a heating rate R1 from 500° C. to a temperature T1 is necessary to be not less than 80° C./s. Preferably, it is not less than 100° C./s. When the heating rate is less than 80° C./s, nuclei of Goss orientation are not sufficiently produced in the primary recrystallization texture after the decarburization annealing, and the effect of reducing the iron loss by refining of secondary recrystallized grains is not obtained sufficiently.

Moreover, the rapid heating method is not particularly limited as long as the above heating rate is attained. For example, an induction heating method, an electric heating method by flowing current through the steel sheet or the like is preferable from a viewpoint of controllability.

Also, a temperature T1 stopping the rapid heating is a certain temperature within a range of 700-800° C. When the temperature T1 is lower than 700° C., the effect by the rapid heating cannot be obtained sufficiently, while when it exceeds 800° C., poor decarburization is easily caused. Preferably, it is any temperature within a range of 700-760° C.

Further, a heating rate R2 from the temperature T1 to a soaking temperature T2 in the decarburization annealing is necessary to be not more than 15° C./s. When the heating rate R2 exceeds 15° C./s, forsterite coating is not formed sufficiently in the finish annealing and the peeling resistance is deteriorated. Moreover, the heating rate R2 is enough to be not more than 15° C./s, but if it is extremely low, a long time is taken in the decarburization annealing and becomes disadvantageous in economical reason, so that it is preferable to be not less than 2° C./s. More preferably, it is a range of 5-12° C./s.

The atmosphere in the decarburization annealing is a wet hydrogen atmosphere from a viewpoint of the decarburization and formation of an oxide layer in the surface layer of the steel sheet. An oxygen potential $P_{H2O}/P_{H2}$ of the atmosphere is enough to be a range of 0.2-0.6 as long as the decarburization property is ensured. In the invention, however, it is preferable to be a range of 0.30-0.55 in view of providing good peeling resistance of the coating. More preferably, it is a range of 0.25-0.40.

A coating weight converted to oxygen per one side surface after the decarburization annealing is preferable to be not more than 0.85 g/m$^2$ from a viewpoint that a dense oxide layer is formed to prevent the penetration of nitrogen into steel during the finish annealing, while a lower limit thereof is preferable to be 0.35 g/m$^2$ from a viewpoint that an absolute amount of forsterite coating formed in the finish annealing is ensured to keep peeling resistance of the coating. A more preferable coating weight converted to oxygen per one side surface after the decarburization annealing is a range of 0.40-0.60 g/m$^2$.

After the arrival at the soaking temperature T2, it is preferable that decarburization is finished by soaking at the temperature T2 for about 130 seconds. Moreover, the time of such a soaking treatment may be changed for the purpose of adjusting the above coating weight converted to oxygen.

Also, the oxygen potential of the atmosphere in the soaking is desired to be the same degree as in the atmosphere at a temperature of not higher than T2, but may be changed for the purpose of adjusting the coating weight converted to oxygen.

In the invention, it is preferable to perform reduction annealing in a reduction zone having an oxygen potential $P_{H2O}/P_{H2}$ of not more than 0.10 at a temperature of not lower than T2 but not higher than 900° C. for not less than 5 seconds after the soaking treatment in the decarburization annealing from a viewpoint that the surface layer of the oxide film formed in the decarburization annealing is reduced to form silica $SiO_2$ to promote the formation of forsterite coating in the finish annealing. The timing of the reduction annealing is not particularly limited, but is preferable to be a final stage of the decarburization annealing just before the start of cooling. Moreover, the oxygen potential $P_{H2O}/P_{H2}$ in the atmosphere of the reduction annealing is preferable to be not more than 0.08.

The steel sheet after the decarburization annealing is then coated on the steel sheet surface with an annealing separator composed mainly of MgO, dried and subjected to finish annealing, whereby the secondary recrystallization texture is developed and forsterite coating is formed. Moreover, the application of the annealing separator to the steel sheet surface is usually a method of applying a slurry, but an electrostatic application having no water content is also effective.

The finish annealing is desirable to be performed at a temperature of not lower than 800° C. for causing the secondary recrystallization. In order to complete the secondary recrystallization, it is desirable to keep at a temperature of not lower than 800° C. for not less than 20 hours. The keeping temperature suitable for the secondary recrystallization is a range of 850-950° C.

When the forsterite coating is not formed with the emphasis on punching workability, it is enough to complete the secondary recrystallization, and hence it is possible to terminate finish annealing at that point. Also, in order to form the forsterite coating to perform purification treatment, it is preferable to heat to approximately 1200° C. after the completion of secondary recrystallization.

The steel sheet after the finish annealing is subjected to planarization annealing for correcting the shape after the annealing separator retained in the steel sheet surface is removed by water cleaning, brushing, pickling or the like, which is effective for reducing the iron loss.

Moreover, when the steel sheets are stacked in use, it is preferable to apply an insulation coating onto the steel sheet surface before or after the planarization annealing in order to improve the iron loss. In order to further reduce the iron loss, the insulation coating is preferable to be a tension-imparting type of imparting tension onto the steel sheet surface. When a method of applying a tension-imparting coating through a binder, or a method of depositing an inorganic substance onto a surface layer of the steel sheet through physical vapor deposition or a chemical vapor deposition is adopted as an application of the insulation coating, the resulting coating has an excellent adhesion property and a significant effect of reducing the iron loss.

In order to further reduce the iron loss, it is preferable to perform magnetic domain refining treatment. As a method of magnetic domain refinement can be used a general method wherein linear grooves or strain zones are formed in a final product sheet by roller working or the like, or liner heat-strain zones or impact strain zones are introduced by irradiating electron beams, laser, plasma jet or the like, or a method wherein grooves are formed on the surface of the cold rolled sheet with the final thickness by etching or the like at steps followed by the cold rolling.

Example 1

A slab containing C: 0.09 mass %, Si: 3.5 mass %, Mn: 0.060 mass %, Al: 0.025 mass %, N: 0.0090 mass %, S: 0.035 mass % and Se: 0.025 mass % is reheated to 1420° C. and hot-rolled to obtain a hot rolled sheet of 2.2 mm in thickness, which is subjected to a hot band annealing at 1150° C. for 60 seconds and cold-rolled to form a cold-rolled sheet having a thickness of 1.5 mm. The cold rolled sheet is subjected to an intermediate annealing at 1100° C. for 80 seconds and finally cold-rolled to form a cold rolled coil having a final thickness of 0.23 mm.

Then, the cold rolled coil is heated to 840° C. under various heating conditions and subjected to decarburization annealing by soaking at 840° C. in a wet hydrogen atmosphere of $P_{H2O}/P_{H2}$=0.40 for 130 seconds. In this case, a sample is taken out from the steel sheet after the decarburization annealing to identify a carbon concentration after the decarburization annealing by an infrared absorption method after combustion and a coating weight converted to oxygen per one-side surface after the decarburization annealing by an infrared absorption method after fusion.

Next, the steel sheet after the decarburization annealing is coated on its surface with an annealing separator composed mainly of MgO, dried and subjected to secondary recrystallization and further finish annealing by keeping at 1150° C. for 5 hours for purification.

Thereafter, 10 specimens having a width of 100 mm and a length of 300 mm are cut out from each of longitudinal front end, middle part and tail end of the coil after the finish annealing in a widthwise direction provided that the rolling direction is the longitudinal direction. With respect to these specimens, an iron loss $W_{17/50}$ is measured at a magnetic flux density of 1.7 T and an excitation frequency of 50 Hz according to JIS C2550. On the other hand, the specimens having a width of 30 mm are wound around various round bars having different diameters in the longitudinal direction to measure a minimum diameter generating no peeling of forsterite coating in the surface layer of the steel sheet for evaluation of peeling resistance (bend and peeling property).

In Table 1 are shown heating conditions in the decarburization annealing, coating weight converted to oxygen per one-side surface after the decarburization annealing, carbon concentration after the decarburization annealing, iron loss $W_{17/50}$ of the steel sheet after the finish annealing and evaluation results of peeling resistance of forsterite coating. Moreover, the iron loss $W_{17/50}$ is an average value measured on all specimens taken at the front end, middle part and tail end of the coil, while the peeling resistance is represented by a worst value among the measured values of all specimens. As seen from Table 1, the steel sheets obtained under the heating conditions adapted to the invention are excellent in the iron loss property and peeling resistance, while more excellent iron loss property is obtained when the coating weight converted to oxygen is within a preferable range defined in the invention.

TABLE 1

| | Conditions of decarburization annealing | | | | Steel sheet after decarburization annealing | | Properties of product sheet | | |
|---|---|---|---|---|---|---|---|---|---|
| No. | Heating rate R1 (° C./s) | Temperature T1 (° C.) | Heating rate R2 (° C./s) | Oxygen potential of atmosphere in heating $P_{H2O}/P_{H2}$ | Coating weight converted to oxygen per one-side surface(g/m$^2$) | C concentration after decarburization annealing (massppm) | Bend and peeling property (mm) | Iron loss $W_{17/50}$ W/Kg | Remarks |
| 1 | 50 | 720 | 10 | 0.38 | 0.48 | 12 | 20 | 0.861 | Comparative Example |
| 2 | 50 | 720 | 20 | 0.38 | 0.46 | 25 | 20 | 0.864 | Comparative Example |
| 3 | 120 | 650 | 10 | 0.38 | 0.47 | 18 | 20 | 0.842 | Comparative Example |
| 4 | 120 | 720 | 10 | 0.38 | 0.48 | 21 | 20 | 0.826 | Invention Example |
| 5 | 120 | 780 | 10 | 0.38 | 0.49 | 20 | 20 | 0.828 | Invention Example |
| 6 | 120 | 830 | 10 | 0.38 | 0.49 | 24 | 20 | 0.836 | Comparative Example |
| 7 | 120 | 750 | 1 | 0.38 | 0.47 | 9 | 20 | 0.827 | Invention Example |
| 8 | 120 | 750 | 5 | 0.38 | 0.47 | 14 | 20 | 0.824 | Invention Example |
| 9 | 120 | 750 | 10 | 0.38 | 0.47 | 21 | 20 | 0.821 | Invention Example |
| 10 | 120 | 750 | 20 | 0.38 | 0.47 | 32 | 20 | 0.823 | Comparative Example |
| 11 | 120 | 750 | 50 | 0.38 | 0.47 | 39 | 20 | 0.827 | Comparative Example |
| 12 | 120 | 750 | 10 | 0.87 | 0.20 | 8 | 30 | 0.814 | Invention Example |
| 13 | 120 | 750 | 10 | 0.45 | 0.39 | 17 | 30 | 0.811 | Invention Example |
| 14 | 120 | 750 | 10 | 0.40 | 0.51 | 19 | 20 | 0.810 | Invention Example |
| 15 | 120 | 750 | 10 | 0.31 | 0.60 | 22 | 20 | 0.823 | Invention Example |
| 16 | 150 | 710 | 9 | 0.51 | 0.36 | 12 | 30 | 0.812 | Invention Example |
| 17 | 150 | 710 | 9 | 0.25 | 0.87 | 24 | 20 | 0.829 | Invention Example |
| 18 | 200 | 720 | 5 | 0.38 | 0.47 | 7 | 30 | 0.822 | Invention Example |
| 19 | 200 | 720 | 10 | 0.38 | 0.47 | 15 | 30 | 0.819 | Invention Example |
| 20 | 200 | 720 | 12 | 0.38 | 0.46 | 20 | 30 | 0.834 | Invention Example |
| 21 | 200 | 720 | 30 | 0.38 | 0.48 | 24 | 30 | 0.841 | Comparative Example |

Example 2

A slab containing C: 0.08 mass %, Si: 3.2 mass %, Mn: 0.09 mass %, Al: 0.026 mass %, N: 0.0085 mass %, S: 0.035 mass % and Se: 0.025 mass % is reheated to 1420° C. and hot-rolled to obtain a hot rolled sheet of 2.2 mm in thickness, which is subjected to a hot band annealing at 1150° C. for 60 seconds and cold-rolled to obtain a cold rolled coil having a thickness of 1.5 mm. The cold rolled sheet is then subjected to an intermediate annealing at 1100° C. for 80 seconds and finally cold-rolled to form a cold rolled coil having a thickness of 0.23 mm.

Then, the cold rolled coil is heated in a wet hydrogen atmosphere of $P_{H2O}/P_{H2}$=0.39 from 500° C. to a temperature T1 (=710° C.) at a heating rate of 150° C./s and from 710° C. to a soaking temperature T2 (=840° C.) at 10° C./s. Thereafter, it is subjected to decarburization annealing by soaking in a wet hydrogen atmosphere of $P_{H2O}/P_{H2}$=0.40 at 840° C. for 100 seconds and further to reduction annealing under a condition that temperature and oxygen potential of atmosphere are variously changed as shown in Table 2.

Next, the steel sheet after the decarburization annealing is coated on its surface with an annealing separator composed mainly of MgO, dried and subjected to secondary recrystallization and further finish annealing for purification by keeping at 1150° C. for 5 hours.

Thereafter, 10 specimens having a width of 100 mm and a length of 300 mm are cut out from each of longitudinal front end, middle part and tail end of the coil after the finish annealing in a widthwise direction provided that the rolling direction is the longitudinal direction. With respect to these specimens, an iron loss $W_{17/50}$ is measured at a magnetic flux density of 1.7 T and an excitation frequency of 50 Hz according to JIS C2550. On the other hand, the specimens are wound around various round bars having different diameters in the longitudinal direction to measure a minimum diameter generating no peeling of forsterite coating in the surface layer of the steel sheet for evaluation of peeling resistance (bend and peeling property).

In Table 2 are also shown the measured results of peeling resistance and iron loss $W_{17/50}$. Moreover, the iron loss $W_{17/50}$ is an average value measured on all specimens taken at the front end, middle part and tail end of the coil, while the peeling resistance is represented by a worst value among the measured values of all specimens. As seen from Table 2, better iron loss property and peeling resistance are obtained by performing the reduction annealing under adequate conditions after the decarburization annealing.

TABLE 2

| | Soaking | Reduction annealing after decarburization annealing | | | Properties of product sheet | | |
|---|---|---|---|---|---|---|---|
| No. | temperature after decarburization annealing T2 (° C./s) | Annealing temperature (° C.) | Treating time (s) | Oxygen potential of atmosphere $P_{H2O}/P_{H2}$ | Bend and peeling property (mm) | Iron loss $W_{17/50}$ (W/kg) | Remarks |
| 1 | 840 | — | 0 | — | 30 | 0.821 | Invention Example |
| 2 | 840 | 840 | 1 | 0.07 | 30 | 0.817 | Invention Example |
| 3 | 840 | 840 | 3 | 0.07 | 30 | 0.814 | Invention Example |
| 4 | 840 | 840 | 8 | 0.07 | 20 | 0.809 | Invention Example |
| 5 | 840 | 840 | 8 | 0.04 | 20 | 0.807 | Invention Example |
| 6 | 840 | 840 | 20 | 0.04 | 20 | 0.805 | Invention Example |

TABLE 2-continued

| | Soaking | Reduction annealing after decarburization annealing | | | Properties of product sheet | | |
|---|---|---|---|---|---|---|---|
| No. | temperature after decarburization annealing T2 (° C./s) | Annealing temperature (° C.) | Treating time (s) | Oxygen potential of atmosphere $P_{H2O}/P_{H2}$ | Bend and peeling property (mm) | Iron loss $W_{17/50}$ (W/kg) | Remarks |
| 7 | 840 | 840 | 40 | 0.04 | 30 | 0.808 | Invention Example |
| 8 | 840 | 840 | 20 | 0.13 | 30 | 0.824 | Invention Example |
| 9 | 840 | 870 | 15 | 0.08 | 30 | 0.807 | Invention Example |
| 10 | 840 | 920 | 15 | 0.08 | 30 | 0.828 | Invention Example |

Example 3

Various slabs having different chemical compositions shown in Table 3 are reheated to a temperature of 1420° C. and hot-rolled to obtain hot rolled sheets of 2.2 mm in thickness, which are subjected to a hot band annealing at 1150° C. for 60 seconds and cold-rolled to form cold rolled sheets having a thickness of 1.5 mm. Each of the cold rolled sheets is subjected to an intermediate annealing at 1100° C. for 80 seconds and finally cold-rolled to form a cold rolled coil having a final thickness of 0.23 mm.

Then, the cold rolled coil is heated in a wet hydrogen atmosphere of $P_{H2O}/P_{H2}$=0.38 from 500° C. to a temperature T1 (=710° C.) at a heating rate of 170° C./s and from 710° C. to a soaking temperature T2 (=840° C.) at 10° C./s. Thereafter, they are subjected to decarburization annealing by soaking in a wet hydrogen atmosphere of $P_{H2O}/P_{H2}$=0.40 at 840° C. for 120 seconds.

Next, the steel sheets after the decarburization annealing are coated on their surfaces with an annealing separator composed mainly of MgO, dried to cause secondary recrystallization and then subjected to finish annealing for purification by keeping at 1150° C. for 5 hours.

Thereafter, 10 specimens having a width of 100 mm and a length of 300 mm are cut out from each of longitudinal front end, middle part and tail end of the coil after the finish annealing in a widthwise direction provided that the rolling direction is the longitudinal direction. With respect to these specimens, an iron loss $W_{17/50}$ is measured at a magnetic flux density of 1.7 T and an excitation frequency of 50 Hz according to JIS C2550 as an average value of all specimens.

In Table 3 are also shown the measured results of the iron loss. As seen from Table 3, grain-oriented electrical steel sheets having an excellent iron loss property are obtained by using a raw steel material having a chemical composition adapted to the invention.

TABLE 3

| | Chemical composition (mass %) | | | | | | | | Iron loss | |
|---|---|---|---|---|---|---|---|---|---|---|
| No. | C | Si | Mn | Al | N | S | Se | Others | $W_{17/50}$ (W/kg) | Remarks |
| 1 | 0.13 | 3.02 | 0.09 | 0.020 | 0.002 | 0.001 | 0.001 | — | 0.890 | Comparative Example |
| 2 | 0.07 | 0.55 | 0.05 | 0.012 | 0.001 | 0.001 | 0.002 | — | 0.934 | Comparative Example |
| 3 | 0.08 | 3.22 | 0.98 | 0.002 | 0.007 | 0.002 | 0.001 | — | 0.881 | Comparative Example |
| 4 | 0.10 | 3.45 | 0.08 | 0.003 | 0.002 | 0.003 | 0.001 | — | 0.984 | Comparative Example |
| 5 | 0.06 | 3.12 | 0.12 | 0.012 | 0.009 | 0.002 | 0.002 | — | 0.827 | Invention Example |
| 6 | 0.05 | 3.60 | 0.20 | 0.004 | 0.003 | 0.003 | 0.022 | — | 0.819 | Invention Example |
| 7 | 0.05 | 3.20 | 0.25 | 0.006 | 0.001 | 0.010 | 0.002 | — | 0.822 | Invention Example |
| 8 | 0.06 | 3.50 | 0.06 | 0.020 | 0.008 | 0.014 | 0.020 | — | 0.822 | Invention Example |
| 9 | 0.08 | 4.01 | 0.05 | 0.019 | 0.012 | 0.008 | 0.003 | Cr: 0.02 | 0.814 | Invention Example |
| 10 | 0.06 | 3.32 | 0.14 | 0.022 | 0.016 | 0.002 | 0.015 | Cu: 0.05 | 0.816 | Invention Example |
| 11 | 0.04 | 2.85 | 0.05 | 0.014 | 0.007 | 0.003 | 0.004 | Ni: 0.06 | 0.814 | Invention Example |
| 12 | 0.06 | 3.75 | 0.15 | 0.020 | 0.007 | 0.010 | 0.008 | Cu: 0.08, P: 0.02, V: 0.006 | 0.809 | Invention Example |
| 13 | 0.03 | 3.00 | 0.08 | 0.018 | 0.015 | 0.006 | 0.004 | Cr: 0.07, Nb: 0.0060 | 0.812 | Invention Example |
| 14 | 0.09 | 3.50 | 0.08 | 0.020 | 0.008 | 0.004 | 0.007 | P: 0.05, Sn: 0.02, B: 0.0008 | 0.811 | Invention Example |
| 15 | 0.05 | 3.25 | 0.04 | 0.030 | 0.016 | 0.023 | 0.007 | Ni: 0.07, Mo: 0.04, P: 0.08 | 0.807 | Invention Example |
| 16 | 0.08 | 3.35 | 0.10 | 0.025 | 0.008 | 0.004 | 0.008 | Sb: 0.02 | 0.815 | Invention Example |

The invention claimed is:

1. A method for producing a grain-oriented electrical steel sheet, the method comprising subjecting a slab having a chemical composition comprising, by mass %:

C: 0.002% to 0.10%;

Si: 2.5% to 6.0%;

Mn: 0.01% to 0.8%;

at least one group selected from the group consisting of:

Group A: Al: 0.010% to 0.050%, and N: 0.003% to 0.020%; and

Group B: at least one of S: 0.005% to 0.03%, and Se: 0.002% to 0.03%; and the remainder being Fe and inevitable impurities, to hot rolling, hot band annealing, one or two or more cold rollings sandwiching an intermediate annealing therebetween to form a steel sheet, formation of subscale on a surface of the steel sheet through decarburization annealing, application of an annealing separator composed mainly of MgO onto the steel sheet surface and finish annealing, wherein when a certain temperature within a range of 700 to 800° C. in a heating process of the decarburization annealing is T1 and a certain temperature as a soaking temperature within a range of 820 to 900° C. is T2, a heating rate R1 between 500° C. and T1 is set to not less than 80° C./s and a heating rate R2 between T1 and T2 is set to not more than 15° C./s, an oxygen potential $P_{H2O}/P_{H2}$ in an atmosphere up to the soaking temperature T2 in the decarburization annealing is within a range of 0.30 to 0.55, and a time of keeping a temperature in a range of T2 to 900° C. and making an oxygen potential $P_{H2O}/P_{H2}$ of the atmosphere to be not more than 0.10 is set to be not less than 5 seconds after the soaking treatment in the decarburization annealing.

2. The method for producing a grain-oriented electrical steel sheet according to claim 1, wherein the time of keeping the temperature in the range of T2 to 900° C. and making the oxygen potential $P_{H2O}/P_{H2}$ of the atmosphere to be not more than 0.10 to be not less than 5 seconds occurs while a temperature is cooled to not higher than 800° C. after the soaking temperature T2 is reached in the decarburization annealing.

3. The method for producing a grain-oriented electrical steel sheet according to claim 1, wherein a coating weight converted to oxygen per one-side surface of the steel sheet after the decarburization annealing is in a range of 0.35 to 0.85 $g/m^2$.

4. The method for producing a grain-oriented electrical steel sheet according to claim 2, wherein a coating weight converted to oxygen per one-side surface of the steel sheet after the decarburization annealing is in a range of 0.35 to 0.85 $g/m^2$.

5. The method for producing a grain-oriented electrical steel sheet according to claim 1, wherein the chemical composition further comprises at least one selected from the group consisting of, by mass %: Cr: 0.01% to 0.50%, Cu: 0.01% to 0.50%, P: 0.005% to 0.50%, Ni: 0.01% to 1.50%, Sb: 0.005% to 0.50%, Sn: 0.005% to 0.50%, Mo: 0.005% to 0.100%, B: 0.0002% to 0.0025%, Nb: 0.0010% to 0.0100%, and V: 0.001% to 0.01%.

6. The method for producing a grain-oriented electrical steel sheet according to claim 2, wherein the chemical composition further comprises at least one selected from the group consisting of, by mass %: Cr: 0.01% to 0.50%, Cu: 0.01% to 0.50%, P: 0.005% to 0.50%, Ni: 0.01% to 1.50%, Sb: 0.005% to 0.50%, Sn: 0.005% to 0.50%, Mo: 0.005% to 0.100%, B: 0.0002% to 0.0025%, Nb: 0.0010% to 0.0100%, and V: 0.001% to 0.01%.

7. The method for producing a grain-oriented electrical steel sheet according to claim 3, wherein the chemical composition further comprises at least one selected from the group consisting of, by mass %: Cr: 0.01% to 0.50%, Cu: 0.01% to 0.50%, P: 0.005% to 0.50%, Ni: 0.01% to 1.50%, Sb: 0.005% to 0.50%, Sn: 0.005% to 0.50%, Mo: 0.005% to 0.100%, B: 0.0002% to 0.0025%, Nb: 0.0010% to 0.0100%, and V: 0.001% to 0.01%.

8. The method for producing a grain-oriented electrical steel sheet according to claim 4, wherein the chemical composition further comprises at least one selected from the group consisting of, by mass %: Cr: 0.01% to 0.50%, Cu: 0.01% to 0.50%, P: 0.005% to 0.50%, Ni: 0.01% to 1.50%, Sb: 0.005% to 0.50%, Sn: 0.005% to 0.50%, Mo: 0.005% to 0.100% B: 0.0002% to 0.0025% Nb: 0.0010% to 0.0100% and V: 0.001% to 0.01%.

9. The method for producing a grain-oriented electrical steel sheet according to claim 1, wherein the surface of the steel sheet is subjected to magnetic domain refining treatment during the formation of subscale on the surface of the steel sheet through decarburization annealing, the application of the annealing separator composed mainly of MgO onto the steel sheet surface, or the finish annealing.

* * * * *